US008006875B2

(12) United States Patent
Watson

(10) Patent No.: US 8,006,875 B2
(45) Date of Patent: Aug. 30, 2011

(54) TRANSPORTABLE SUPPORT SYSTEM FOR DIVE EQUIPMENT

(76) Inventor: Chad Michael Watson, Vancouver, WA (US)

( * ) Notice: Subject to any disclaimer, the term of this patent is extended or adjusted under 35 U.S.C. 154(b) by 560 days.

(21) Appl. No.: 12/287,976

(22) Filed: Oct. 14, 2008

(65) Prior Publication Data

US 2010/0089959 A1 Apr. 15, 2010

(51) Int. Cl.
*A45F 3/14* (2006.01)

(52) U.S. Cl. ..... 224/250; 224/580; 224/584; 224/254; 224/602; 224/651; 294/149; 294/150; 294/165

(58) Field of Classification Search ..... 224/580, 224/584, 250, 254, 255, 615, 602, 603, 651, 224/656, 677, 246, 916, 563; 248/693; 294/150, 294/165, 149, 152

See application file for complete search history.

(56) References Cited

U.S. PATENT DOCUMENTS

| | | | | | |
|---|---|---|---|---|---|
| 215,399 | A * | 5/1879 | Schaefer et al. | ..... | 224/626 |
| 3,933,287 | A * | 1/1976 | Foley | ..... | 294/149 |
| 4,790,460 | A * | 12/1988 | Harper, Jr. | ..... | 224/644 |
| 4,887,752 | A * | 12/1989 | Nauta | ..... | 224/621 |
| 5,083,692 | A * | 1/1992 | Treese | ..... | 224/615 |
| 5,285,939 | A * | 2/1994 | Hogan | ..... | 224/250 |
| 5,579,966 | A * | 12/1996 | Krumweide et al. | ..... | 224/637 |
| 5,695,101 | A * | 12/1997 | Frietze | ..... | 224/250 |
| 5,863,088 | A * | 1/1999 | Kelly et al. | ..... | 294/146 |
| 5,918,785 | A * | 7/1999 | Irose | ..... | 224/259 |
| 6,923,356 | B2 * | 8/2005 | Reynolds | ..... | 224/585 |

* cited by examiner

*Primary Examiner* — Justin Larson
*Assistant Examiner* — Steven M Landolfi, Jr.
(74) *Attorney, Agent, or Firm* — Mark S. Hubert

(57) ABSTRACT

A transportable support system for underwater dive equipment that is durable, lightweight, adjustable, and compact, allowing the diver to effectively and rapidly secure his fins, regulator assembly, mask, and various other items for storage and/or transport. The support system can be employed with a "hands free" design via the use of a shoulder strap, or secured in a dive bag or suitcase for airline travel.

10 Claims, 9 Drawing Sheets

TRANSPORTABLE SUPPORT SYSTEM FOR DIVE EQUIPMENT

FIELD OF THE INVENTION

The present invention relates to underwater diving generally and more specifically to a support system for organizing and securing underwater dive equipment.

BACKGROUND OF THE INVENTION

When diving your equipment is your life. Malfunctioning of equipment can, at the very least, result in a ruined dive vacation, and at the worst, result in serious injury or death. For this reason, dive enthusiasts will spend hundreds and even thousands of dollars on equipment. Necessary equipment includes: fins, mask, primary and back-up regulator, high pressure adaptor (tank hook-up), gauge cluster, a buoyancy compensation device (BCD), and an air tank, all of which are essential for a safe dive. In addition, a diver could have a wet suit, a snorkel, a flashlight, an underwater buoy, a line marker, a dive knife, a camera, and dive computers. All of these mission critical, expensive, and cumbersome items need to make it to the dive shop and from the dive shop to the diving location, which can be a lengthy boat ride, or often a drive, followed by an overland hike to a drop-in site.

Thus there exists a need for a transportable support system for organizing and securing mission critical dive equipment.

SUMMARY OF THE INVENTION

In accordance with the preferred embodiment of this invention, an object of the present invention is to provide a support system for organizing essential dive equipment for easy transport.

It is another object of this invention to provide a support system for organizing essential dive equipment that will attach within a backpack, or suitcase for long-term transport, e.g., airplane travel.

It is a further object of this invention to provide a support system for organizing essential dive equipment capable of being transported in a "hands free" manner, thereby allowing the diver to more easily maneuver with his own equipment or assist others in reaching the dive site or boat.

It is still a further object of this invention to provide a compact support system for organizing essential dive equipment that can be easily stored when not in use.

It is still a further object of this invention to provide an support system for organizing essential dive equipment that is both water resistant in part and water permeable in part to allow for fresh water cleaning of essential equipment after a lengthy sea dive. The diver can simply dunk the entire assembly in a fresh water tank when he returns to the dive shop after his dive.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1:
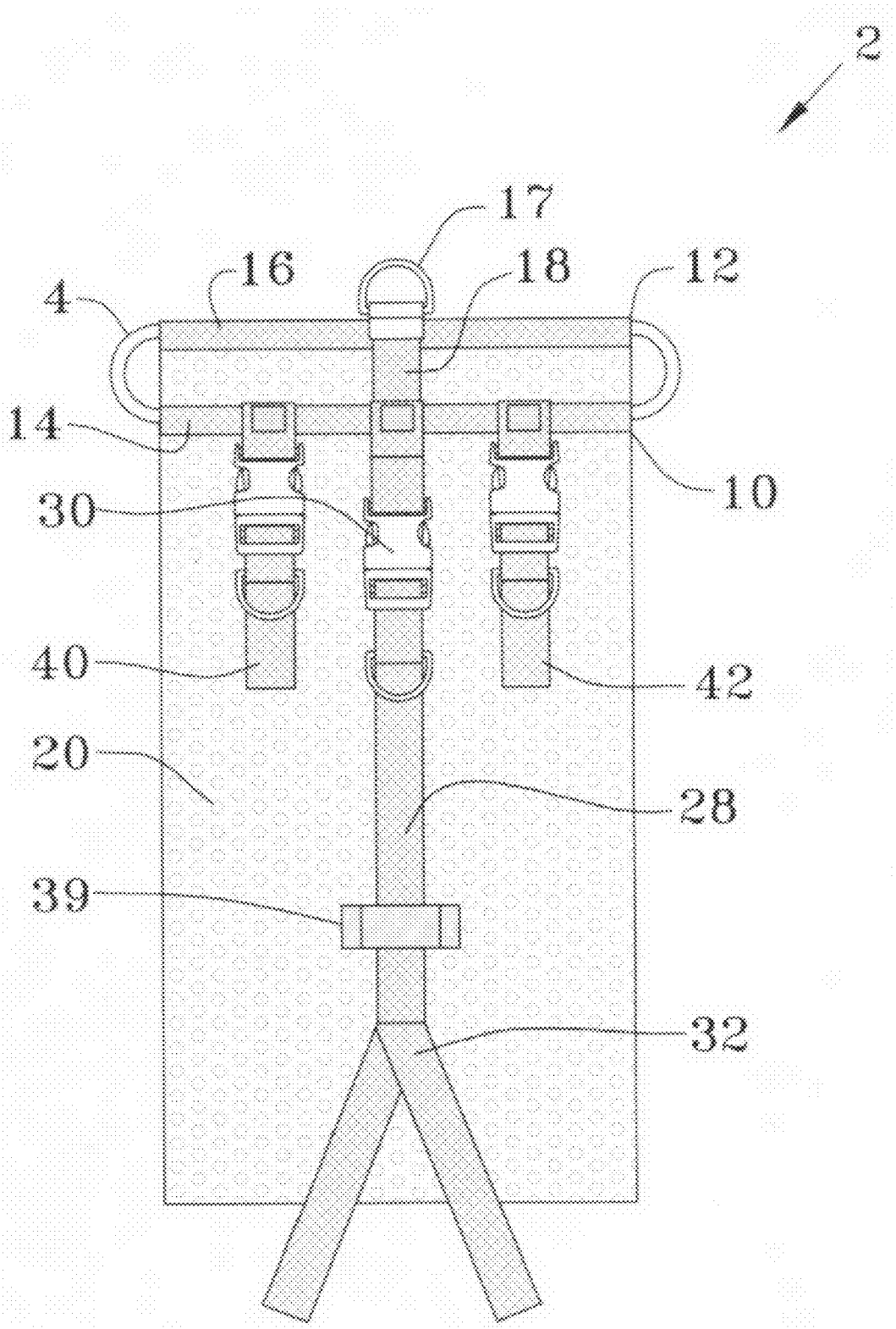
FIG. 1. is a front view of the present invention.
Figure 2:
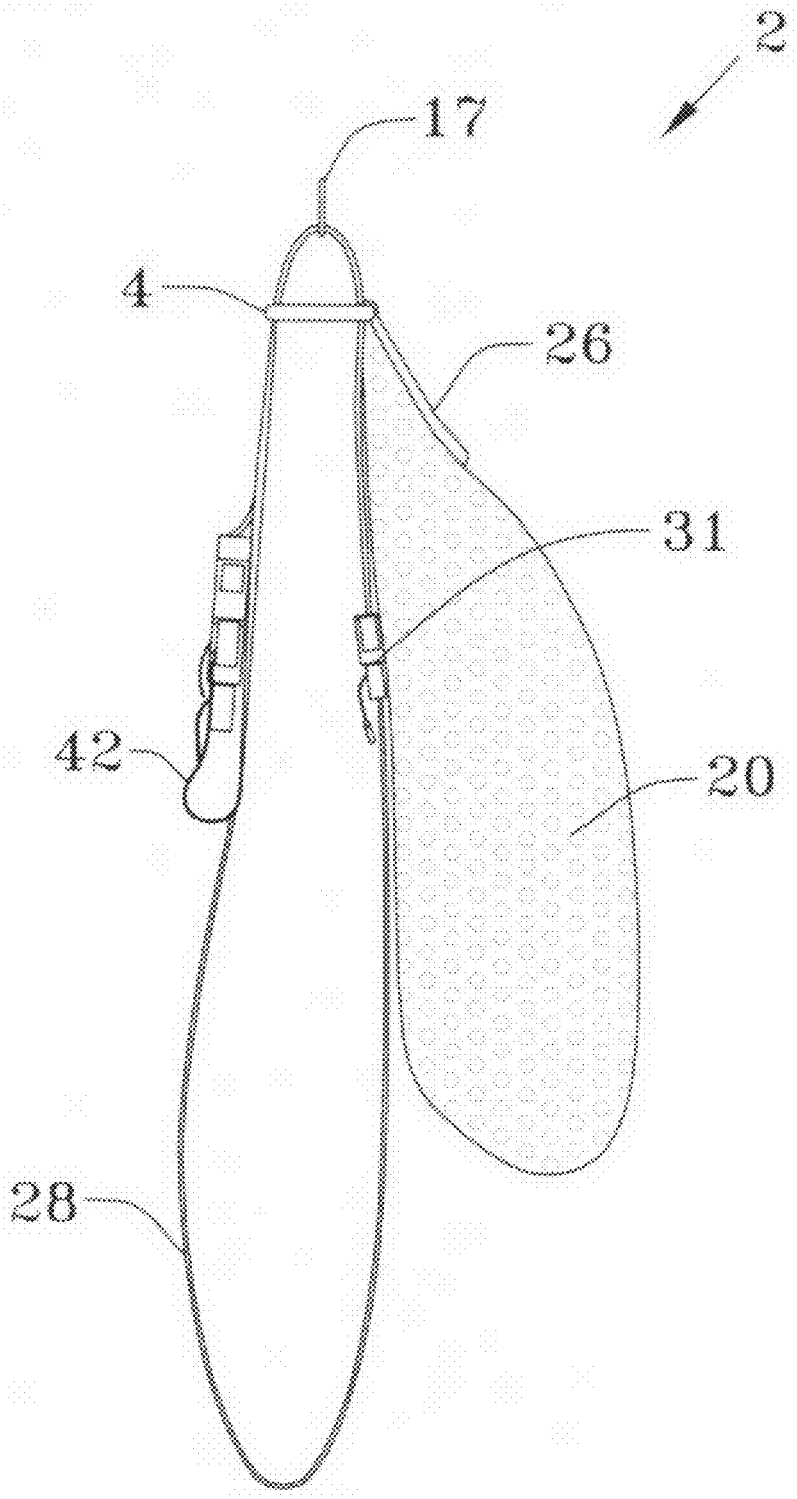
FIG. 2. is a side view of the present invention.
Figure 3:
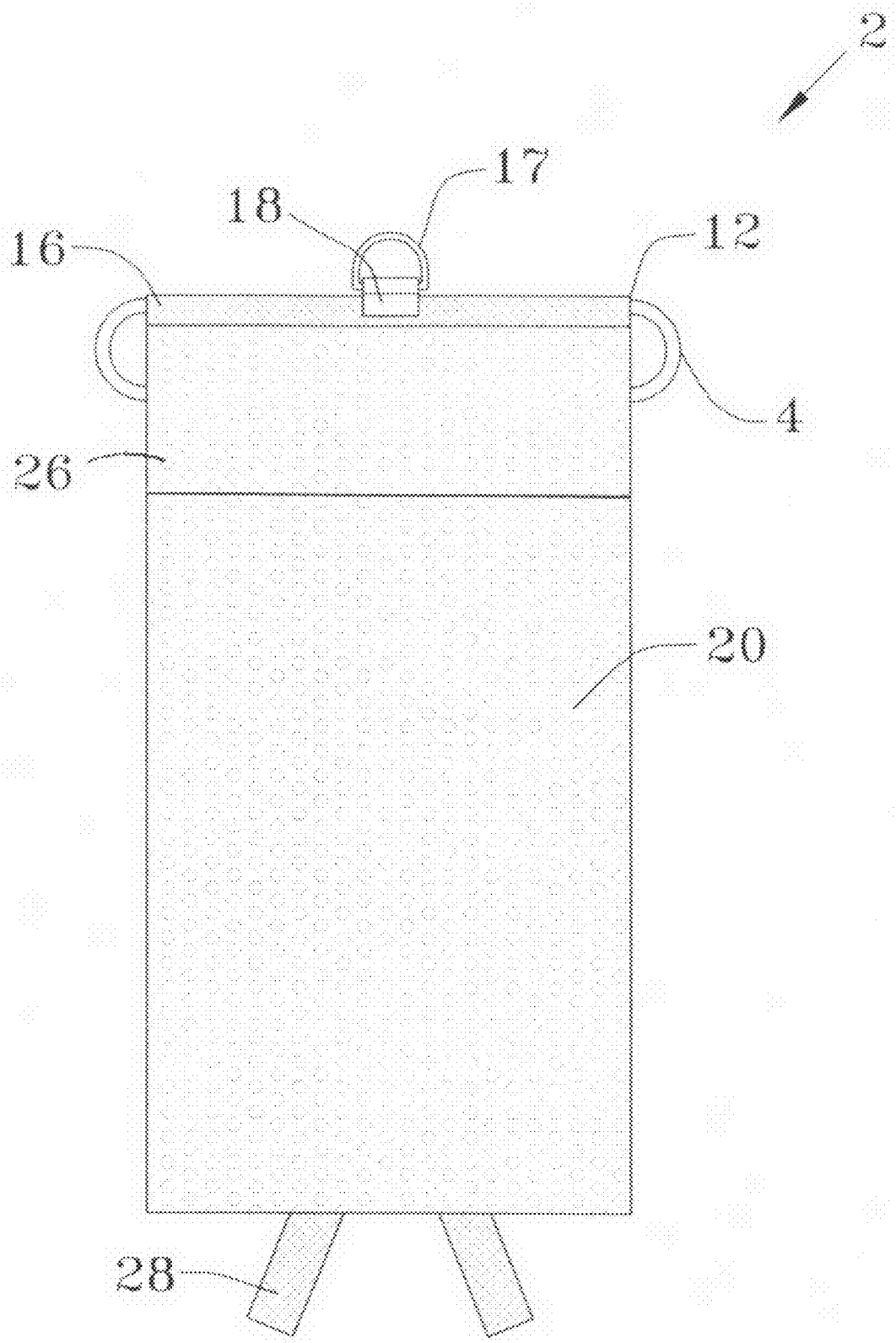
FIG. 3. is a back view of the present invention.
Figure 4:
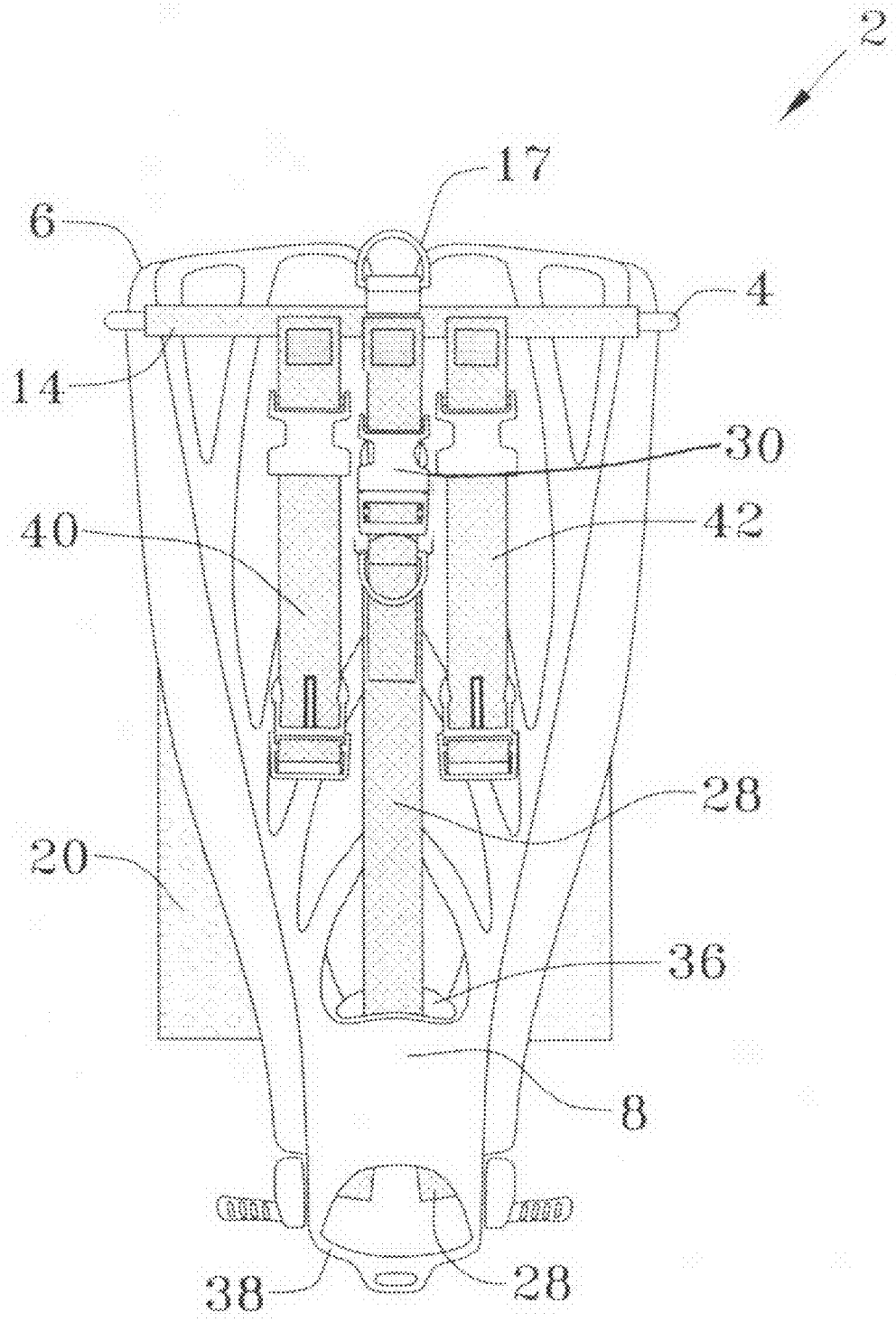
FIG. 4. is a front view of the present invention operatively securing dive fins.

Referring now to FIG. 1-3, the preferred embodiment of the transportable support system for dive equipment 2 comprises a loop 4 of resilient elasticized polymer cording sized to securely accommodate the distal ends 6 of dive fins 8 (See FIG. 4, which has had the D rings removed from strap/buckle assemblies 40 and 42 for visual clarity) by encirclement. Loop 4 is elliptical in shape and has a front face 10 and a back face 12, which reside on opposite sides of the major axis of loop 4. Additionally, front face 10 and back face 12 are reinforced and enlarged with a first strip of ballistic nylon 14 and a second strip of ballistic nylon 16 stitchedly attached thereon. First strip 14 and second strip 16 provide the additional surface area and support required for the addition of straps and buckles there from. A carrying D ring 17 is affixed via a carrying strap 18. Carrying strap 18 is affixed at one end to the front face 10 and at its other end to the back face 12 at their respective mid-points such that carrying D ring 16 resides above the plane of loop 4.

Figure 9:
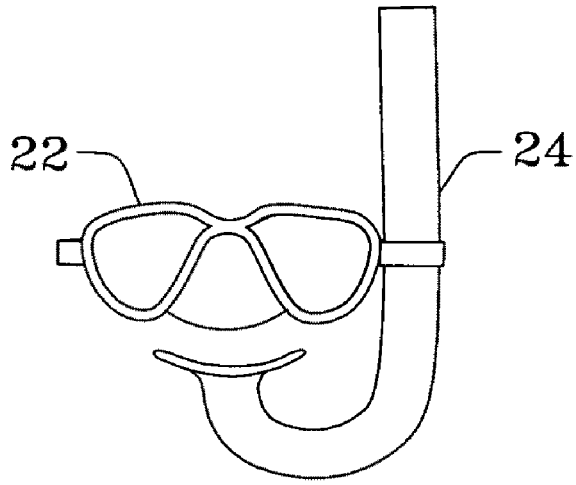
FIG. 9. is a front view of a dive mask and snorkel assembly.
Figure 10:
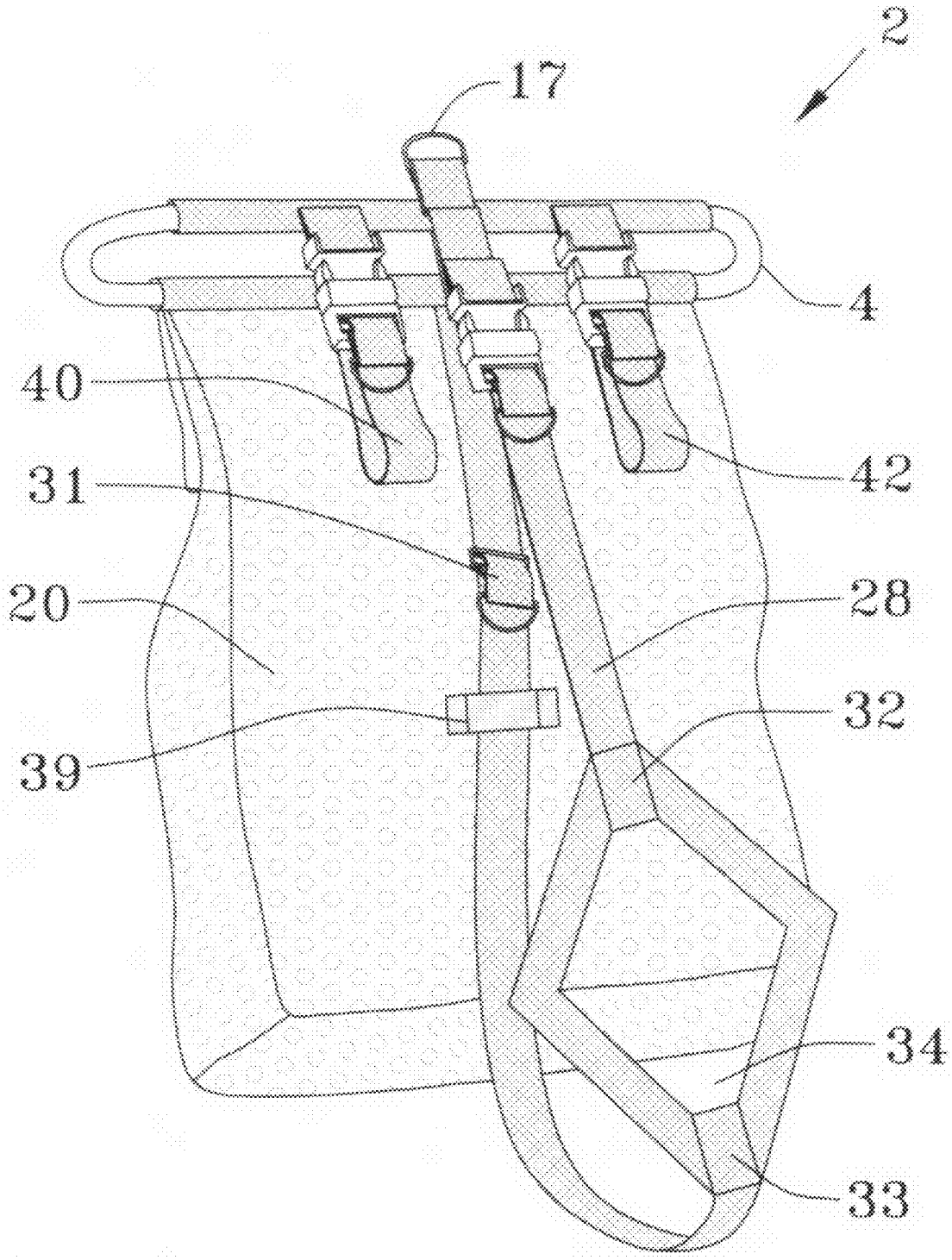
FIG. 10. is a perspective view of the present invention illustrating the cradle or stirrup portion of the fin retention strap.

Stitchedly attached along the longitudinal axis of second strip 16 is a synthetic dive mesh bag 20 ideal for dive mask 22 and snorkel 24 storage (See FIGS. 9 and 10). Looking at FIG. 2, it can be seen that mesh bag 20 is opened and closed via a rectangular flap 26, which is also stitchedly attached along the longitudinal axis of second strip 16. Flap 26 can be mechanically affixed to mesh bag 20 via an adjustable side release buckle (not shown) or by various other fastening means, which are well known in the art for the secure storage of items within mesh bag 20.

Stitchedly attached at the mid-point of the first strip 14 and second strip 16 and residing perpendicular to both strips 14 and 16 is the adjustable fin retention strap 28. The fin retention strap 28 is a three piece construction of ballistic nylon with one half of an adjustable, polymer side release buckle 30 stitchedly connected to the free end of a first strap section stitchedly attached at the mid-point of the first strip 14, and the matingly conformed second half of the buckle slideably retained on the second strap section, by the interweaving of the second strap section through a set of slots formed in the buckle second half. Looking at FIG. 10, the second strap forks at a first overlap junction 32 to form a generally diamond shaped cradle 34 which reconnects at a second overlap junction 33 and extends as a single strap that is interwoven through a series of slots formed in a strap lengthening means 31 that is stitchedly attached by a very short third strap to second strip 16. It should be noted that all of the buckles and strapping arrangements used herein are of the same basic design regardless of their function.

This diamond shaped cradle configuration (which could also be more elliptical in shape depending on construction) is important for accommodating full-foot dive fins. The area within the cradle 34 creates a pocket or stirrup which the heel portion of the fin resides within, such that the heel portion of the fins are encircled by the diamond shaped cradle 34. If the diver is using heel-strap fins this configuration is not necessary and the fin retention strap 28 could be a single strap.

The free end of the second strap section has a D ring sewn thereon to facilitate hand adjustment. The strap lengthening means 31 aides in the centering of the of the cradle 34 about proximal ends 38 of different sized dive fins 8.

To help retain fin retention strap 28 in a centered position about the support system's vertical axis, a strap guide 39 resides centered along the backside (that is the side of mesh bag 20 which opposes flap 26) of mesh bag 20.

Referring now to FIG. 4-7, in use, a diver places the distal ends 6 of fins 8 through loop 4 until distal ends 6 of fins 8 abut carrying D ring 17. At this point the tips of the fins 8 are encircled by loop 4. The buckle 30 is unfastened and the free end (second strap section) is directed through the toe hole 36 of the fins 8 and around the proximal end 38 of the fins, looping back to buckle 30 for adjustable, secured fastening. Fins 8 are now securely fastened within fin retention strap 28.

Figure 7:
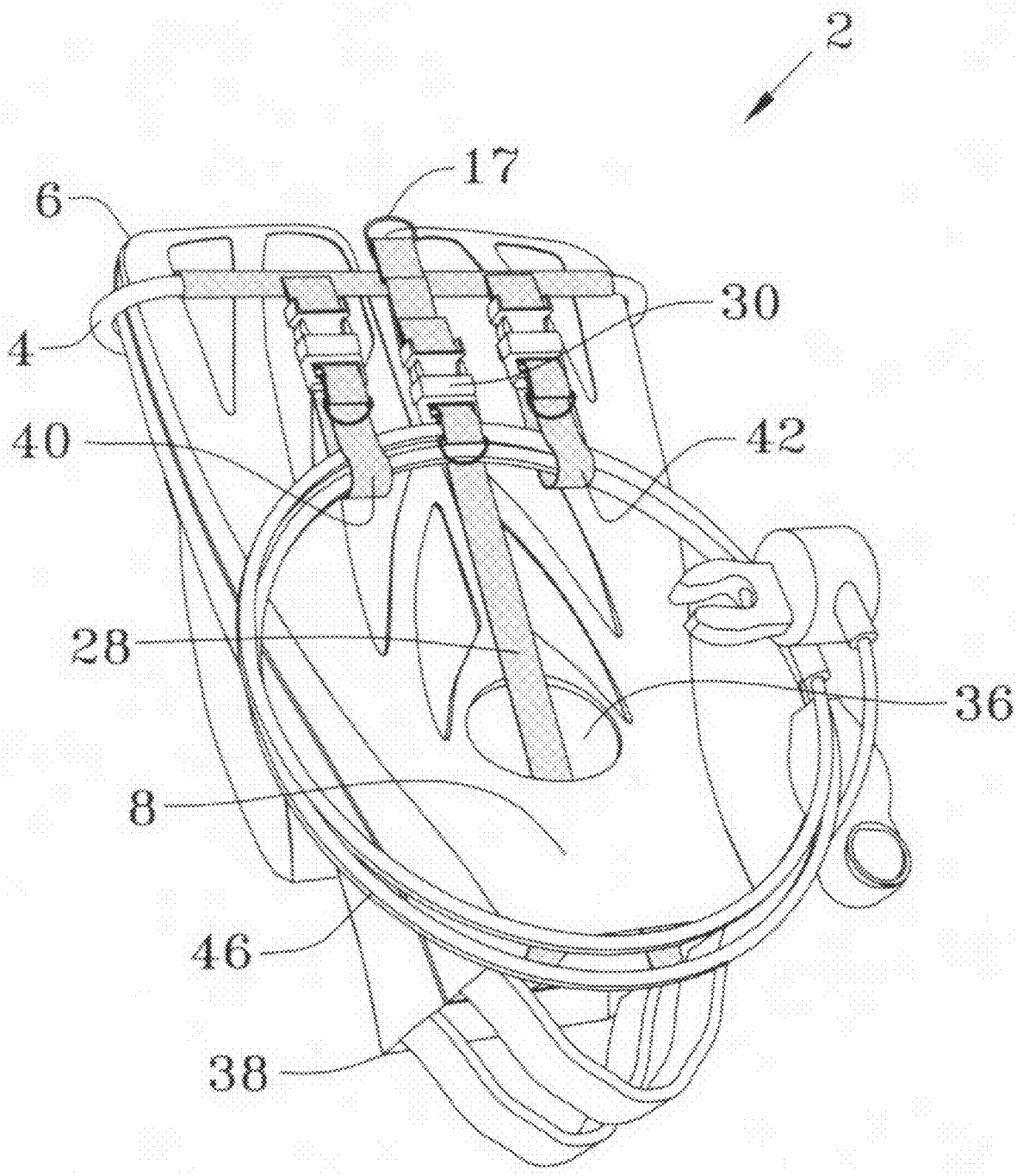
FIG. 7. is a perspective view of the present invention operatively securing dive fins, regulator, and gauge cluster.
Figure 8:
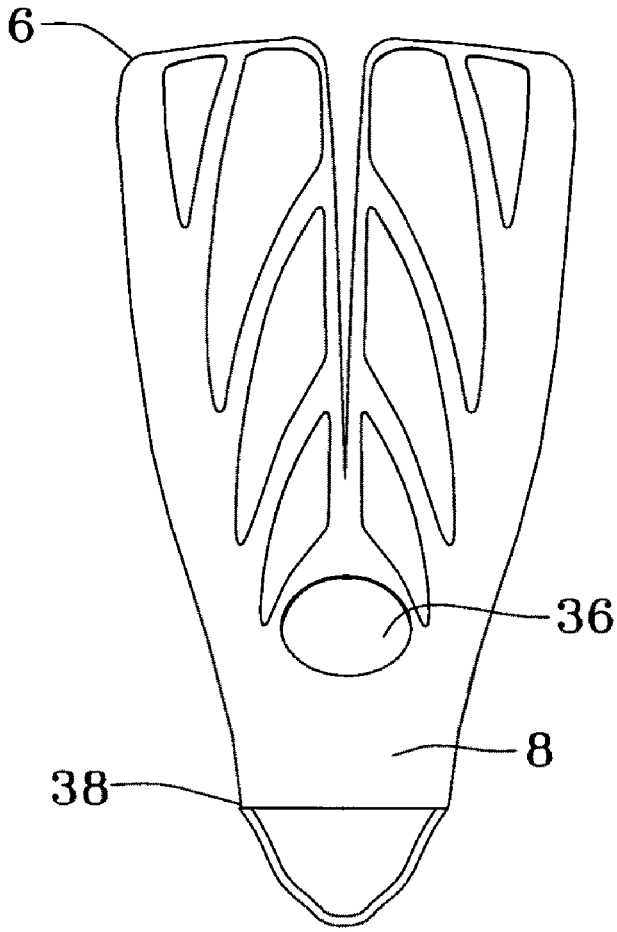
FIG. 8. is a front view of a dive fin.

Looking at FIG. 7, it can be seen that fin retention strap 28 is flanked by a first regulator retention strap/buckle assembly 40 and a second regulator retention-strap/buckle assembly 42, stitchedly affixed by a short length of strapping to first strip 14 and residing perpendicularly to strip 14. To secure the regulator assembly (that is the high pressure adapter, BCD inflation gauge, gauge cluster, and primary and back-up regulator) hoses 46, the diver coils the hoses 46, in a similar fashion as one would store a garden hose or electrical cord, unfastens strap/buckle assemblies 40 and 42 and loops the free end of the assemblies 40 and 42 around the hoses 46 and fastens the strap/buckle assemblies 40 and 42. The regulator assembly hoses 46 are now securely fastened. For visual clarity, in FIG. 5-7 only the gauge cluster and regulator are shown.

Figure 5:
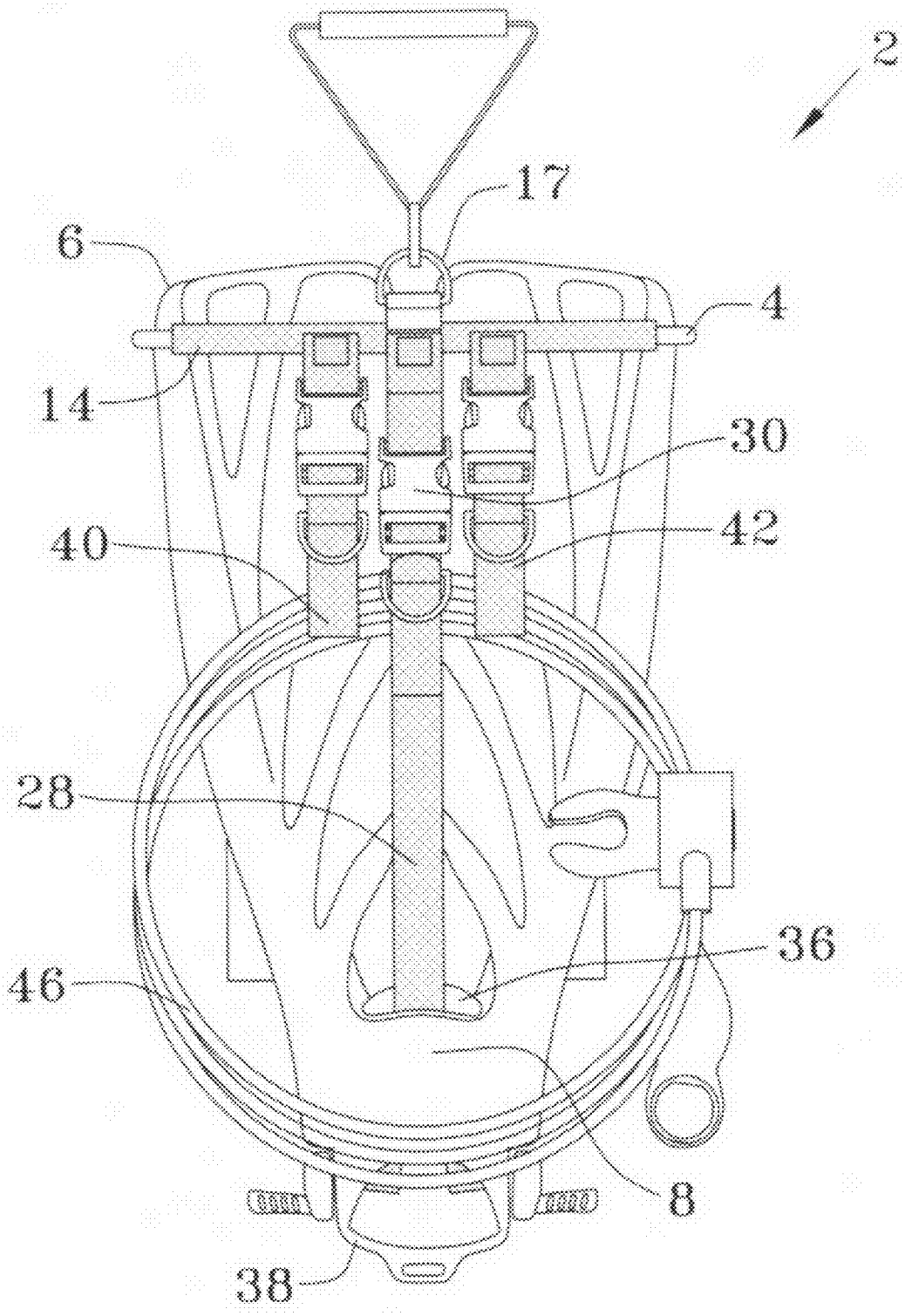
FIG. 5. is a front view of the present invention, operatively securing dive fins, regulator, and gauge cluster and illustrates a handle attachment.
Figure 6:
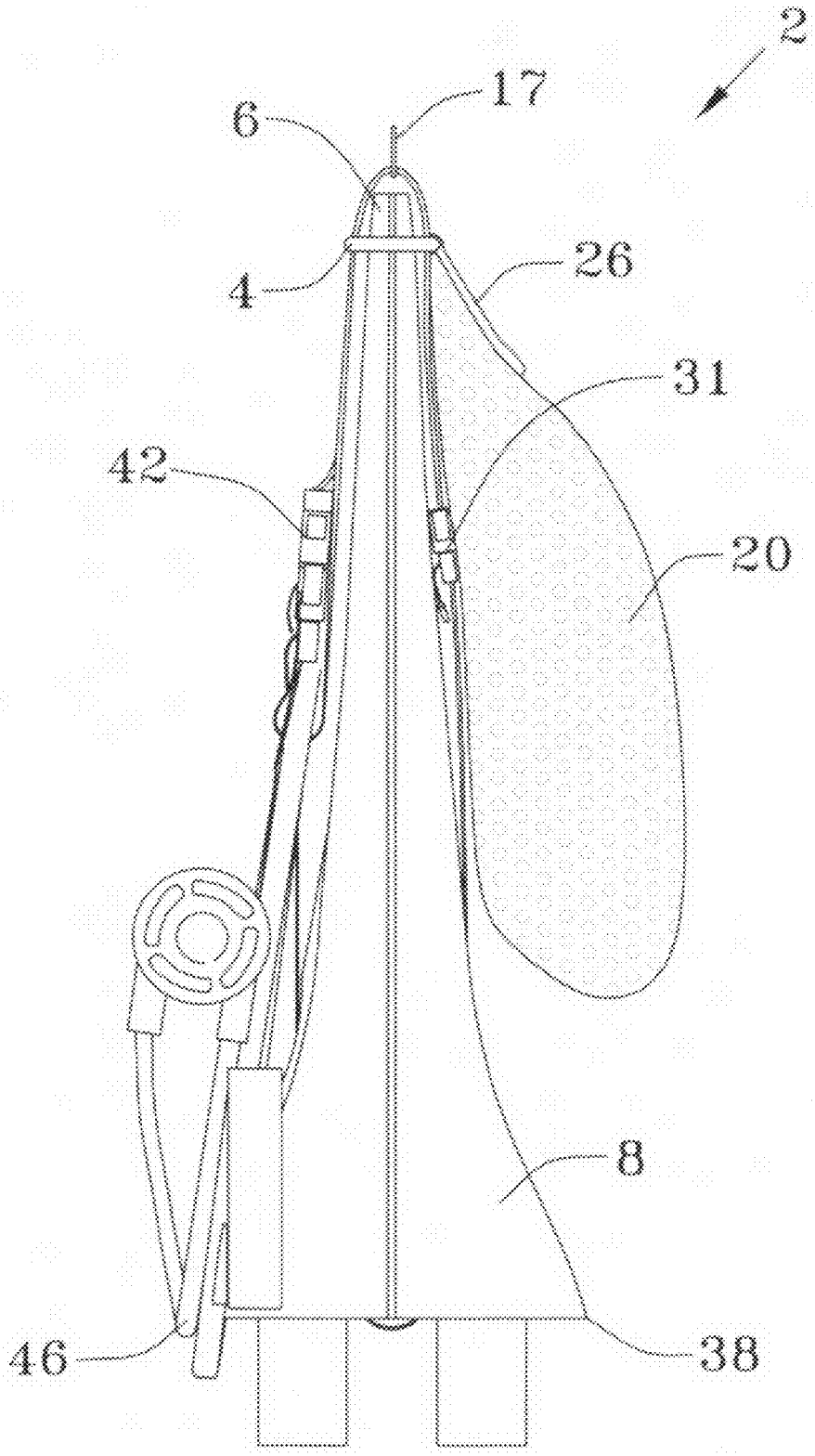
FIG. 6. is a side view of the present invention, operatively securing dive fins, regulator, and gauge cluster.

The support system 2 can now be securely affixed within a dive bag or suitcase via the carrying D ring 17, or for a shorter distance, a handle or shoulder strap can be attached via the carrying D ring 17 as would be well known in the art. FIG. 5 illustrates the present invention with a handle attachment. With a shoulder strap a diver can carry his fins, regulator assembly, mask, and other small items "hands free," allowing greater maneuverability. Once the dive boat or drop-in site is reached the transportable support system can be rolled up and stored in the smallest of places, and upon return to the dive shop the diver can dunk his mask, fins, and regulator assembly into a fresh water, clean tank without his expensive, personal dive equipment becoming lost amongst the other divers' equipment.

It should be noted that the preferred method of mechanically affixing the fabric straps via stitching could be accomplished via a variety of different methods, such as such as adhesive bonding, polymer seal welding, pop rivets, or other fastening means. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Having thus described the invention, what is claimed as new and desired to secure by Letters Patent is as follows:

1. A transportable support system for underwater dive equipment comprising:

a loop of flexible, resilient elasticized polymer cording sized to securely accommodate the widest portion of dive fins with a front face and back face residing opposite one another;

a first strip of resilient polymer webbing stitchedly affixed along said front face;

a second strip of resilient polymer webbing stitchedly affixed along said back face;

a carrying strap stitchedly affixed at the midpoint of said first strip of resilient polymer webbing and stitchedly affixed at the midpoint of said second strip of resilient polymer webbing;

a securing ring affixed at the midpoint of said carrying strap;

a synthetic dive mesh bag stitchedly attached along the longitudinal axis of said second strip;

a rectangular flap of synthetic dive mesh, stitchedly attached along the longitudinal axis of said second strip for closing and opening of said bag;

a fin retention strap stitchedly attached at the mid-point of said first strip and the midpoint of said second strip and residing perpendicular said first and said second strips capable of securing the heel portion of a dive fin;

a first regulator retention strap stitchedly affixed to said first strip and residing perpendicular to said first strip;

a second regulator retention strap stitchedly affixed to said first strip and residing perpendicular to said first strip.

2. The transportable support system of claim 1 wherein said fin retention strap further comprises at least one, adjustable, releaseable tensioning member.

3. The transportable support system of claim 2 wherein said fin retention strap further comprises a generally diamond shaped cradle for the retention of full-foot and heel-strap dive fins.

4. The transportable support system of claim 3 wherein said first regulator retention strap and said first and second regulator retention straps further comprise at least one, adjustable, releaseable tensioning member.

5. A transportable support system for underwater dive equipment comprising:

a loop of flexible, resilient elasticized polymer cording sized to securely accommodate the widest portion of dive fins with a front face and back face residing opposite one another;

a first strip of resilient polymer webbing stitchedly affixed along said front face;

a second strip of resilient polymer webbing stitchedly affixed along said back face;

a carrying strap stitchedly affixed at a first end to the midpoint of said first strip of resilient polymer webbing and stitchedly affixed at its second end to the midpoint of said second strip of resilient polymer webbing;

a securing ring affixed at the midpoint of said carrying strap;

a synthetic dive mesh bag stitchedly attached along the longitudinal axis of said second strip;

a rectangular flap of synthetic dive mesh, stitchedly attached along the longitudinal axis of said second strip for closing and opening of said bag;

a fin retention strap having a first end stitchedly attached at the mid-point of said first strip and a second end stitchedly attached to the midpoint of said second strip, and residing perpendicular to said first and said second strips wherein said fin retention strap has at least one, adjustable, releaseable tensioning members affixed thereto, and a generally diamond shaped cradle for the retention of full-foot and heel-strap dive fins;

a first regulator retention strap stitchedly affixed to said first strip and residing perpendicularly to said first strip; and a second regulator retention strap stitchedly affixed to said first strip and residing perpendicularly to said first strip;

wherein said first and second regulator retention straps have at least one, adjustable, releaseable tensioning member affixed thereto.

6. The transportable support system of claim 5 wherein said rectangular flap is releaseably affixed to said mesh bag via a side release buckle.

7. The transportable support system of claim 6 wherein said adjustable, releaseable tensioning members are side release buckles.

8. The transportable support system of claim 7 further comprising a handle capable of removable engagement with said carrying ring.

9. The transportable support system of claim 8 further comprising a shoulder strap capable of removable engagement with said carrying ring.

10. A transportable support system for underwater dive equipment comprising:

a loop of flexible, resilient elasticized polymer cording sized to securely accommodate the widest portion of dive fins with a front face and back face residing opposite one another;

a first strip of resilient polymer webbing stitchedly affixed along said front face;

a second strip of resilient polymer webbing stitchedly affixed along said back face;

a carrying strap having a first end stitchedly affixed at the midpoint of said first strip of resilient polymer webbing and a second end stitchedly affixed at the midpoint of said second strip of resilient polymer webbing;

a securing ring affixed at the midpoint on said carrying strap;

a handle capable of removable engagement with said carrying ring a synthetic dive mesh bag stitchedly attached along the longitudinal axis of said second strip;

a rectangular flap of synthetic dive mesh, stitchedly attached along the longitudinal axis of said second strip for closing and opening of said bag with a side release buckle thereon for engagement of said bag;

a fin retention strap with a first end stitchedly attached at the mid-point of said first strip and a second end stitchedly attached at the midpoint of said second strip that resides perpendicular to said first and said second strips, and wherein said fin retention strap forms a generally diamond shaped cradle thereon for the retention of full-foot and heel-strap dive fins; and a first regulator retention strap with at least one side release buckle thereon, stitchedly affixed to said first strip and residing perpendicular to said first strip; and and a second regulator retention strap with at least one side release buckle thereon, stitchedly affixed to said first strip and residing perpendicular to said first strip and said first and second regulator retention straps further comprise at least one side release buckle.

* * * * *